United States Patent [19]

Fulk

[11] 4,068,973

[45] Jan. 17, 1978

[54] METHOD FOR MANUFACTURE OF BUSINESS FORMS

[75] Inventor: James B. Fulk, Saratoga, Calif.

[73] Assignee: Paper Converting Machine Company, Green Bay, Wis.

[21] Appl. No.: 700,138

[22] Filed: June 28, 1976

Related U.S. Application Data

[63] Continuation-in-part of Ser. No. 606,647, Aug. 21, 1975, abandoned.

[51] Int. Cl.[2] ..... B65H 41/00

[52] U.S. Cl. ..... 270/52.5; 270/61 F

[58] Field of Search ..... 270/52.5, 52, 61 F, 270/79, 43, 10, 73; 197/133 F; 101/228, 232

[56] References Cited

U.S. PATENT DOCUMENTS

| | | | |
|---|---|---|---|
| 2,181,117 | 11/1939 | Brenn | 270/21 |
| 2,334,283 | 11/1943 | Pfeiffer | 270/52.5 |
| 2,975,989 | 3/1961 | Hinman | 270/52.5 |
| 3,143,342 | 8/1964 | Pine | 270/52.5 |
| 3,972,520 | 8/1976 | McKeefry | 270/52.5 |

*Primary Examiner*—Edgar S. Burr
*Assistant Examiner*—A. Heinz
*Attorney, Agent, or Firm*—Tilton, Fallon, Lungmus, Chestnut

[57] ABSTRACT

Method for manufacture of business forms in which at least three superposed continuous business form webs are processed and thereafter separated for individual folding, all but one of the webs being shifted laterally into two-wide folders for zig-zag folding.

5 Claims, 2 Drawing Figures

METHOD FOR MANUFACTURE OF BUSINESS FORMS

This application is a continuation-in-part of my copending application, Ser. No. 606,647, filed Aug. 21, 1975, now abandoned.

BACKGROUND AND SUMMARY OF INVENTION

This invention relates to a method for handling business forms, and more particularly, to a method which zig-zag folds at least three webs separately in side-by-side relation. As such, it constitutes an improvement upon my earlier U.S. Pat. No. 3,596,899.

In that patent, a method of producing web units was disclosed wherein at least two webs were superposed for simultaneous processing and thereafter laterally separated for zig-zag folding. The method of this prior patent was an improvement over machines which had both two-wide processing and folding in that it eliminated the need for greater diameter printing press cylinders, which in turn necessitated additional plates, thereby creating problems of register. Also the U.S. Pat. No. 3,596,899 was an improvement over the prior tandem machines (2 single width folders in line) which required one operator at each folder.

Although apparatus for performing the method of my prior patent has been known throughout the world since Oct. 1969 — when it was demonstrated at an international exhibition in Milan, Italy, and notwithstanding the fact that the method has become highly successful commercially — being practiced in over forty machines throughout the world (each operating at speeds of the order of 1000 feet per minute) no one has seen fit to apply the patented method to three or more webs. This is all the more startling when it is considered that with a modest investment in an additional two-wide folder, four webs can be produced whereas only two could be produced before — and the finished product handled by the same artisan that previously handled the two folded webs. Thus there is possible an increase of 100% in production (and when this occurs at 1000 feet per minute, it seems strange that no one appreciated the instant invention). Also, even though 2 wide folders had been used by the industry for over 10 years, nobody arranged them in side-by-side relationship until this invention.

More importantly, the logical or obvious move to increase production over that available from the machine of the U.S. Pat. No. 3,596,899 was to go to a three-wide folder, i.e., moving a third web to the other or "unused" side of the basic path in the U.S. Pat. No. 3,596,899. This would be consistent with the prior art approach of having webs symmetrically disposed on both sides of the path. However, this obvious step would not achieve the goal of increased production.

The U.S. Pat. No. 3,596,899 machine was set up to run at 1000 feet per minute, and further can be rapidly changed over to run different web weights and patterns. For example, the tucker and gripper relationship of the folder has to be changed slightly — even with the same repeat — when the weights are changed, as from a 10 lb/ream to a 12 lb/ream web. The mechanism for doing this in a two-wide folder is relatively simple — cams for closing the grippers being provided at each end of the folder, one each for the adjacent folder. However, with a three-wide folder, a fairly complicated internal mechanism is required for actuating and timing the movement of the grippers in the middle folder — mechanism sufficiently complicated that the art has generally avoided three-wide folders. Also, use of a three-wide folder could result in a substantial reduction of speed because of the wider span (nominally 45 inches versus 30 inches — the typical business form being 15 inches wide) would require lower speed operation to avoid vibration. Thus, the logical move would not only complicate the mechanism but, more importantly would not achieve the desired goal — increased production. For example, if the speed of a three-wide folder had to be reduced ⅓ — to 667 feet per minute compared to a two-wide folder set up, the three web production would still aggregate only 2,000 feet per minute — just what was being produced on the U.S. Pat. No. 3,596,899 two-wide folder.

It was not obvious to go to two two-wide folders — this based on the fact that the use of a second two-wide folder would require a substantial lateral shift of the third web — of the order of 53 inches (35 inches gap between paper edges) as contrasted to about 20 inches (2 inches gap between paper edges) in the U.S. Pat. No. 3,596,899 machine. Admittedly, webs were shifted substantially in the prior art but not webs that were traveling at 1000 feet per minute and in the midst of processing. The contra-indication of going to a separate folder in the high speed operation of the U.S. Pat. No. 3,596,899 machine was borne out in the building of the machine according to the disclosure in this application. Several years were involved and after the machine was installed in the customer's plant, several months elapsed before the operation was proper.

DETAILED DESCRIPTION

Figure 1:
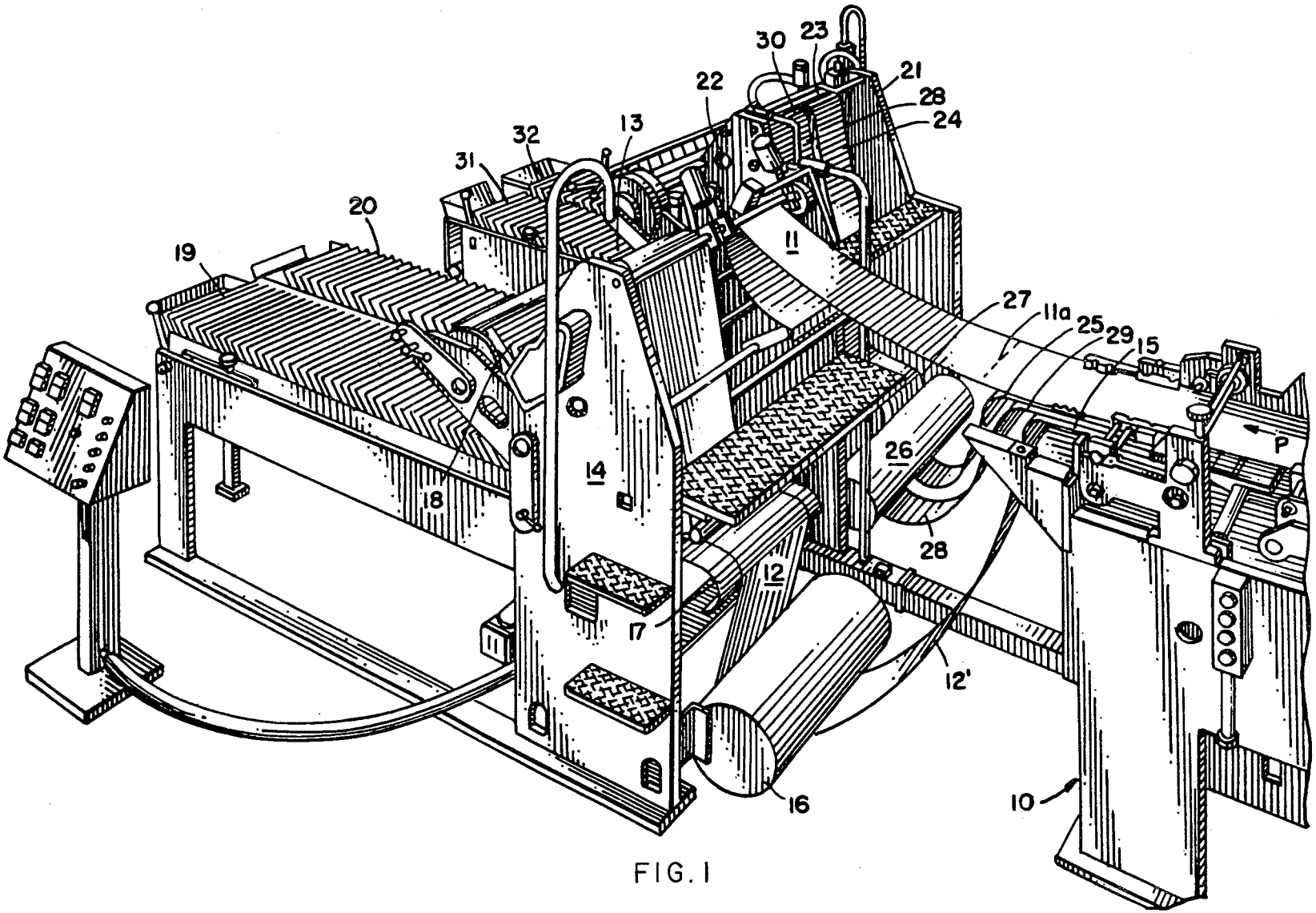
Figure 2:
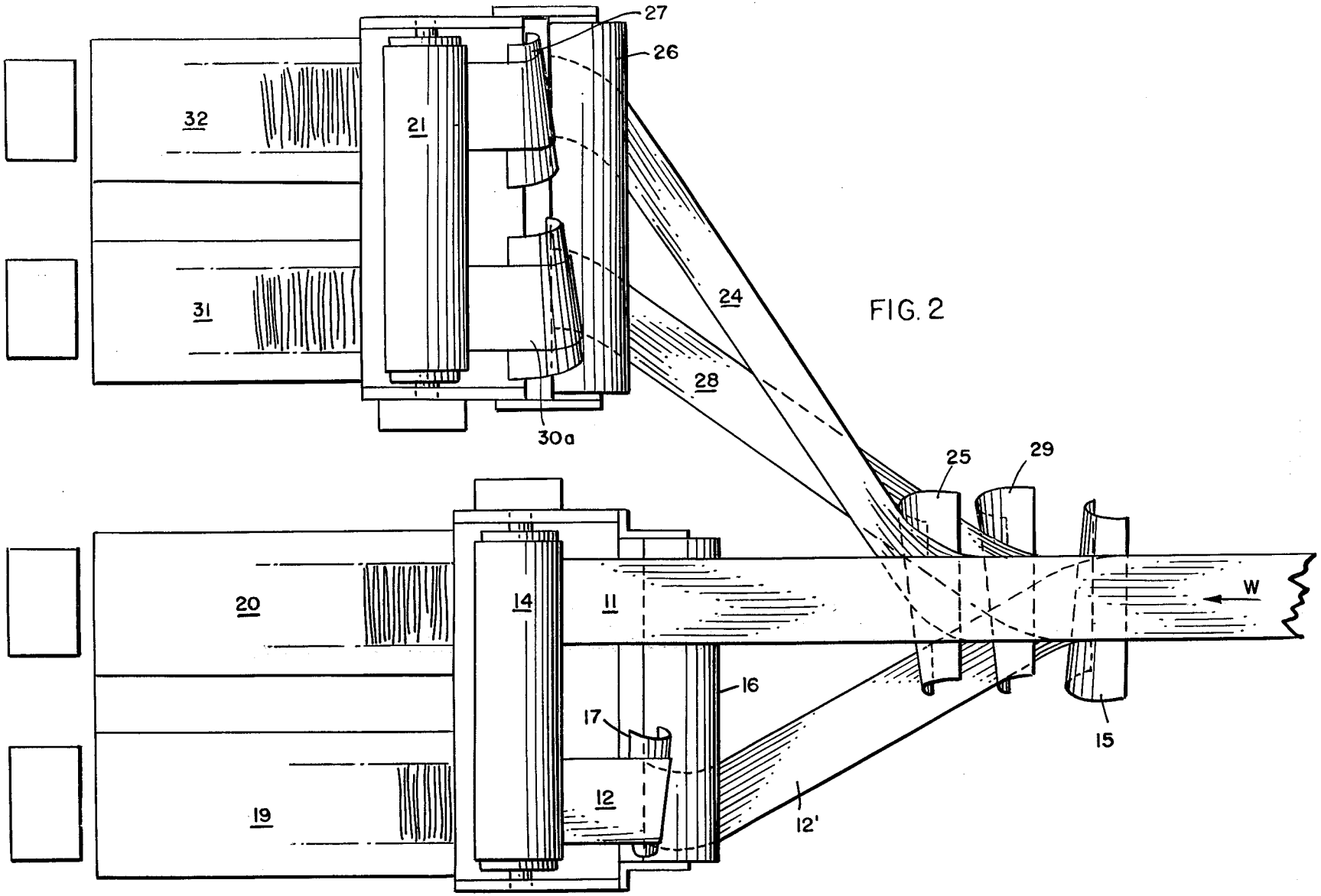

The invention is described in conjunction with an illustrative embodiment, in the accompanying drawing in which FIG. 1 is a fragmentary perspective view of apparatus embodying the teachings of this invention relative to four webs; and FIG. 2 is a diagrammatic plan view of the apparatus of FIG. 1.

In the illustration given, the numeral 10 designates generally the frame of the machine employed to process a plurality of business form webs simultaneously. The machine may take the form of the machine shown in greater detail in my prior U.S. Pat. No. 3,596,899. That patent shows a business form machine having an unwind station from which webs are unwound from parent rolls, directed through printing units, and thereafter conducted through various processing units such as across-perforation, pin hole punching, crash numbering, crimp locking and line-hold punching. Inasmuch as these operations and the structure therefor are well known in the art, the details thereof are omitted here, it being sufficient to point out that, according to the instant invention, the web structure W issuing from the machine frame 10 (having traveled along path P), includes at least three webs which have been processed simultaneously. To show the versatility of the invention, four webs are shown being processed and folded.

These four webs are identified as follows in the drawing. The uppermost web unit is designated 11 while the lowermost web unit is designated 12. These two web units are handled in accordance with the prior method set forth in U.S. Pat. No. 3,596,899. In other words, the uppermost web 11 is maintained generally in the path P and proceeds through the right hand folder 13 of a two-wide folder 14. The lowermost web 12 is conducted around a skewed member 15 which permits it to be offset laterally — see the position designated 12' in FIG. 1. Thereafter the web 12 passes around a stationary drum 16 and around a reversely skewed member 17 so as to travel in a path parallel to but laterally spaced from the path P in which the web 11 is traveling. Thereafter, the web 12 passes through the left hand folder 18 and is delivered in the form of a stack of zig-zag business forms 19 which is seen to be in side-by-side relation with the similar stack 20 resulting from the web 11.

The intermediate pair of webs (as illustrated) are ultimately handled by a second two-wide folder 21. This is essentially identical to the folder 14 — having two folding rolls mounted on a common shaft 22. The right hand folding unit 23 of the two-wide folder 21 handles the upper web 24 of the intermediate pair of webs of the web structure W. As can be appreciated from the central right hand portion of FIG. 1, the web second from the top (which is designated 24) passes around a skewed member 25 and thereafter around a stationary drum 26 before traveling over a reversely skewed member 27. Thereafter, the web 24 is directed along a path parallel to the original path P into the folding unit 23.

The web 28 which is the third from the top in the superposed structure W encounters a skewed member 29 which ultimately directs it into the left hand folding unit 30 of the folder 21 — via the stationary drum 26 and a reversely skewed member 30*a* (see FIG. 2). This results in a stack 31 which is seen to be in side-by-side relation to the stack 32 developed from folding the web 24. Thus, with a shortened delivery table in folder 21, all the stacks 19, 20, 31 and 32 are in side-by-side relation presenting a common front transverse to the path P.

It will be noted in the drawing that in the embodiment of the machine practicing the invention, that the two-wide folder 21 is spaced slightly "downstream" of the two-wide folder 14.

As well as being spaced forwardly of the folder 14, the folder 21 is spaced laterally, i.e., horizontally to accommodate an artisan who may be changing the cam arrangement for different timing of the grippers of the folder. In the illustration given, the web stacks 19 and 20 are normally spaced apart 1–2 inches (also the stacks 31 and 32 issuing from the folder 31). However, the stacks 20 and 31 (hence the webs 11 and 28) are spaced apart at considerably greater distance in the illustration given, about three feet. Notwithstanding this greater spacing, the webs 25 and 28 can be shifted laterally to achieve a substantial increase in production with the addition of only minor equipment, viz., skew members, a two-wide folder and stack receivers.

Further, this arrangement permits some additional space for the lateral shifting of the webs 24 and 28, utilizing the same type of stationary drum and skewed member arrangement as is employed with respect to the web 12. Through the use of other turning means or angled elements, it is possible to alter the alignment. As shown, the webs 12, 24 and 28 are somewhat slack during the lateral shift but register is maintained through timing belts (not shown) on each of the folders 13, 18, 23 and 30. These timing belts (which are also used in the main apparatus carried by the frame 10) engage line holes along the longitudinal edges of each of the webs and insure that a transverse fold occurs along a cross perforation such as is exemplified at 11a relative to the web 11. At present, most business forms have a height, i.e., distance between perforations of 8–½ inches, or 11 inches, depending upon the usage, and the across perforations are normally provided on this same spacing. This facilitates the bursting of the business forms after they have been processed by the ultimate user through data processing equipment such as a computer printer.

The inventive arrangement improves the flexibility or versatility of the machine substantially. On a six web machine which is the most common arrangement, there are the following possibilities for product mix off of the two two-wide folders: looking at the delivery end, the stacks 19, 20, 31, and 32 of FIG. 1 could have the following product mix:

| Stack | 19 | 20 | 31 | 32 |
|---|---|---|---|---|
| Number of Parts in Form | 1 | 1 | 1 | 1 |
| | 2 | 2 | 2 | 2 |
| | 2 | 2 | 1 | 1 |
| | 2 | 1 | 1 | 1 |
| | 1 | 3 | 1 | 1 |
| | 2 | 3 | 1 | |
| | 1 | 4 | 1 | |

This was exceptionally advantageous because the industry required more one part forms. This was brought about by developments in the computer printers and in copying machines. Therefore, the demand was for very high production of single part forms, and this invention solved the problem. Further, it offers the flexibility of running very productively on two, three, and four-part forms which constitute the majority of all continuous forms made. One can see from the chart that when running a four-part form on stack 20, the single part form in stack 19 and 31 go along virtually at no additional operating cost.

I claim:

1. In a method for manufacture of business forms, the steps of advancing at least three superposed webs along a generally horizontal processing path wherein said webs are simultaneously and continuously processed, said processing including at least across perforation, advancing only one of said webs further in said path to a two-wide folder and zig-zag folding said one web, moving one of the remaining webs laterally of said path to a second path parallel to the first mentioned path and introducing the same into said two-wide folder and zig-zag folding the same, moving the other of said remaining webs a distance laterally of the first mentioned path substantially further than the distance said one of the remaining webs was moved laterally into a third path parallel with said first mentioned path and then folding said other of said remaining webs in a second folder separate from said two wide folder, said folders being generally aligned in a direction transverse of said first mentioned path whereby at least three stacks of zig-zag folded webs are presented in side-by-side relation along a common front for takeaway.

2. The method of claim 1 in which one of said remaining webs is moved laterally to one side of said path and another of said remaining webs is moved laterally to the other side of said path prior to folding.

3. The method of claim 2 in which at least two webs are moved laterally to one side of said path prior to folding.

4. The method of claim 1 in which the second mentioned folder is also a two-wide folder.

5. The method of claim 1 in which said webs are advanced at a speed of about 1,000 feet per minute.

* * * * *